United States Patent [19]

Umezaki

[11] Patent Number: 4,803,454

[45] Date of Patent: Feb. 7, 1989

[54] IGNITION COIL

[75] Inventor: Tomokazu Umezaki, Himeji, Japan

[73] Assignee: Mitsubishi Denki Kabushiki Kaisha, Tokyo, Japan

[21] Appl. No.: 192,637

[22] Filed: May 11, 1988

[30] Foreign Application Priority Data

May 13, 1987 [JP] Japan ..... 62-117421

[51] Int. Cl.[4] ..... H01F 15/10

[52] U.S. Cl. ..... 336/192; 336/96; 336/198

[58] Field of Search ..... 336/105, 107, 192, 198, 336/208, 96; 310/71; 29/605; 242/125, 125.1, 125.2

[56] References Cited

U.S. PATENT DOCUMENTS 3,555,477 1/1971 Hildebrandt ..... 336/192

*Primary Examiner*—Thomas J. Kozma

*Attorney, Agent, or Firm*—Oblon, Fisher, Spivak, McClelland & Maier

[57] ABSTRACT

An ignition coil have a secondary winding wound on and around a secondary bobbin, have one end of the secondary winding connected to a high voltage terminal, and have a portion of the secondary winding close to the connected end engaged with a binding portion formed on a circumferential edge of one end of the secondary bobbin, wherein the binding portion comprises a winding piece which projects outwardly in the radial direction of the secondary bobbin and around which an end portion of the secondary winding is wound in several turns, and an engaging piece which is formed to extend from the leading edge of the winding piece along the central axis of the secondary bobbin and which has a side surface formed with a groove for inserting the secondary winding for clipping.

1 Claim, 3 Drawing Sheets

IGNITION COIL

BACKGROUND OF THE INVENTION

1. Field of the Invention

The present invention relates to an ignition coil, and particularly to the structure of a secondary bobbin which constitutes the ignition coil.

2. Discussion of Background

In the past, ignition coils for an internal combustion engine have been constructed as shown in FIGS. 5 and 6. In FIGS. 5 and 6, the ignition coils comprise a casing 1 made of a thermoplastic material, an iron core 2 inserted in a cylindrical hole la which is arranged in the center of the casing 1 as one unit, and a primary coil 3 placed around the outer wall of the cylindrical hole 1*a*. The primary coil is constituted by winding a primary winding 3*b* on a primary bobbin 3*a* in 50–150 turns. The primary winding 3*b* has a wind-starting end 3*c* and a wind-ending end 3*d*.

Around the primary coil 3 is placed a secondary coil 4. The secondary coil 4 comprises a secondary bobbin 4*a* and a secondary winding 4*b* wound on the secondary bobbin in about 6,000–12,000 turns. A high voltage cord 5 has one end inserted in a recess 6 which is formed to extend from the bottom of the casing 1 inwardly. Into the end surface of the one end of the cord is pierced a high voltage terminal 7 like a rivet from the inside of the casing 1 through a top wall of the recess. The secondary bobbin 4*a* of the secondary coil 4 has a top circumferential end with a binding portion 4*c* formed integrally with the circumferential end so that the binding portion projects outwardly in the radial direction of the bobbin. The binding portion 4*c* is in the form of T-letter as seen from above the bobbin. The secondary winding 4*b* has a one end connected to the high voltage terminal 7 by soldering or similar way after a portion of the secondary winding close to the connected end is wound around the binding portion 4*c* in several turns. The other end of the secondary winding 4*b* is connected to the wind-ending end of the primary winding 3*b* of the primary coil 3. A thermosetting resin 8 such as epoxy resin is filled in the casing 1 in order to fix the primary coil 3 and the secondary coil 4 in an insulating state in the casing 1.

In the conventional ignition coils, the secondary winding 4*b* which is wound on and around the seconary bobbin 4*a* has the portion close to the connected end wound on and around the T-shaped binding portion which is formed the top circumferential edge of the bobbin 4*a*, and has the connected end connected to the high voltage terminal 7. It is a disadvantage of the conventional ignition coils that the wire wound on the binding portion can lift, or sometimes comes loose due to slack to form a short circuit with the secondary winding. If such short circuit is formed, a required voltage can not be obtained with the secondary coil 4 and the discharge voltage at a spark plug in the internal combustion engine is thus decreased to cause a flame-out.

SUMMARY OF THE INVENTION

It is an object of the present invention to eliminate the disadvantage of the conventional ignition coils and to provide a new and improved ignition coil capable of positively fixing the end portion of the secondary winding wound around the secondary bobbin at the binding portion.

The foregoing and the other objects of the present invention have been attained by providing a ignition coil having the end portion of a secondary winding wound around a secondary bobbin, having the end portion connected to a high voltage terminal and having a portion of the secondary winding closed to the connected end portion engaged on a binding portion which is formed on a circumferential edge of the end of the secondary bobbin, wherein the binding portion comprises a winding piece which projects outwardly in the radial direction of the secondary bobbin and on which the end portion of the secondary winding is wound in several turns, an engaging piece which is formed to extend from the leading end of the winding piece along the central axis of the secondary bobbin so as to be integral with the winding piece and which has in its side surface a groove for inserting the secondary winding to clip it.

In accordance with the ignition coil of the present invention, the wind-ending end of the secondary winding wound on the secondary bobbin is inserted into the groove formed in the side surface of the engaging piece to be clipped or held therein after it is wound on and around the winding piece of the binding portion in several turns. Since the end portion of the secondary winding is inserted into the groove in the side surface of the engaging piece to be engaged therein, the direction of the lifting force which tends to make the end portion of the secondary winding lift from the winding piece is perpendicular to the length of the groove. As a result, the groove holds the end portion of the winding to prevent the winding from slacking at the winding piece.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
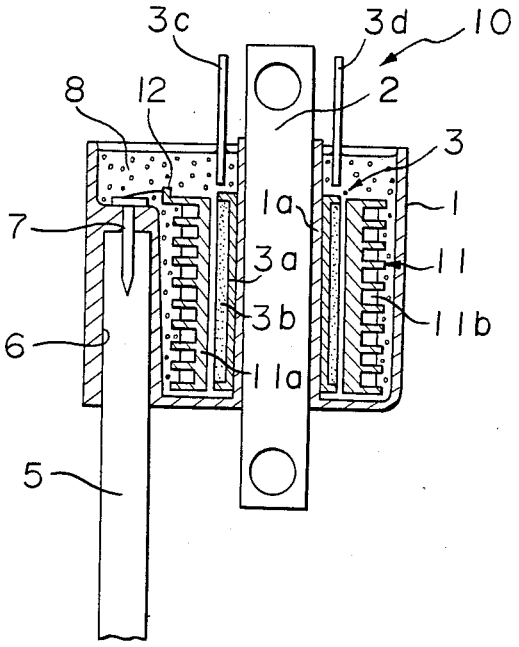
FIG. 1 is a vertical sectional view showing an embodiment of the ignition coil according to the present invention.
Figure 2:
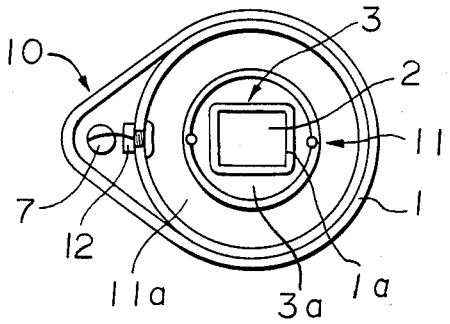
FIG. 2 is a plan view showing the ignition coil shown in FIG. 1, wherein a sealing member is removed.
Figure 5:
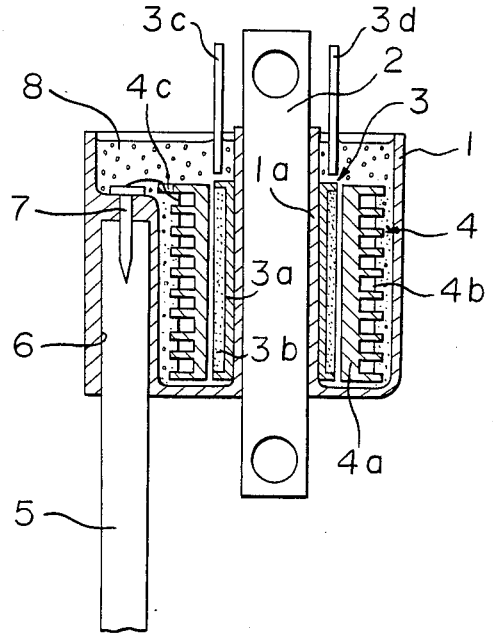
FIGURE 5 PRIOR ART
FIG. 5 is a vertical sectional view showing the conventional ignition coil.
Figure 6:
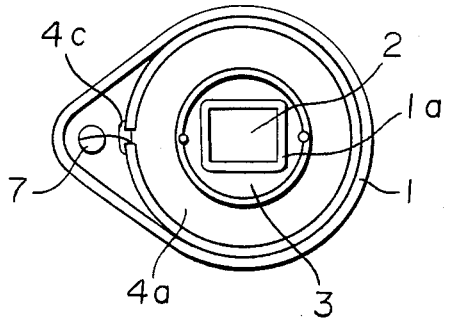
FIGURE 6 PRIOR ART
FIG. 6 is a plan view showing the conventional ignition coil wherein a sealing member is removed.

Referring now to the drawings, wherein like reference numerals designate identical or corresponding parts throughout the several views, and more particularly to FIGS. 1 and 2, there is shown an typical example of the ignition coil 10 of the present invention. With regard to FIGS. 1 and 2, parts identical or corresponding to those of the conventional ignition coil as shown in FIGS. 5 and 6 are designated by the same reference numerals and explanation on those parts is omitted for the sake clarity.

Figure 3:
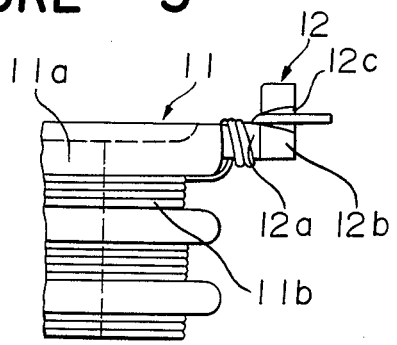
FIG. 3 is a enlarged fragmentally side view showing a binding portion of a secondary bobbin in the ignition coil shown in FIG. 1.
Figure 4:
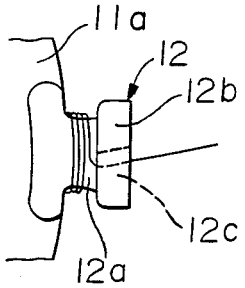
FIG. 4 is a plan view showing the binding portion as shown in FIG. 3.

A cylindrical secondary bobbin 11*a* is arranged around a primary coil 3 and a secondary winding 11*b* is wound on and around the secondary bobbin 11*a* to constitute a secondary coil 11. On a top circumferential end of the secondary bobbin 11*a* is formed a binding portion 12 so as to be integral with the bobbin. The binding portion 12 comprises a winding piece 12*a* projecting outwardly in the radial direction of the bobbin, and an engaging piece 12*b* extending from the leading edge of the winding piece 12*a* in the central axis of the bobbin 11*a* so as to be integral with the winding piece, as shown in FIGS. 3 and 4. The binding portion has an L-shape in vertical section as a whole. The engaging piece 12*b* has one side surface formed with a notch in a substantially horizontal direction to form a groove 12*c* so that the width of the notch is slightly greater than the diameter of the secondary winding 11*b*.

The wind-ending end of the secondary winding 11*b* wound around the secondary bobbin 11*a* is wound on and around the winding piece 12*a* of the binding portion 12 in several turns, and then it is inserted into the groove 12*c* of the engaging piece 12*b* from laterally of the engaging piece 12*b* and is pulled out outwardly in the radial direction of the secondary bobbin 11*a*. This end of the secondary winding is connected to a high voltage terminal 7 by soldering and so on. Since the end portion of the secondary winding 11*b* is wound around the winding piece 12*a* in several turns, the winding wound around the secondary bobbin 11*a* is prevented from slacking. In addition, the occurrence of slack in the wire wound around the winding piece 12*a* is avoided by inserting the end portion of the wire into the groove 12*c* formed in the side surface of the engaging piece 12*b*. In the conventional ignition coils, the wire is wound around the winding piece 12*a*, and in particular a portion of the wire close to its leading edge tends to lift from the winding piece 12*a* the slack produced thus spreads in the other portion of the winding. In the embodiment, the secondary bobbin 11*a* is formed so that the engaging piece 12*b* has the side surface formed the groove 12*c* in the substantially horizontal direction so as to insert the end portion of the wire into the groove 12*c* for clipping. As a result, even if the wind-ending portion of wire on the winding piece 12*a* is about to lift from there, the upper wall forming the groove 12*c* prevents the wind-ending portion from lifting to avoid the occurrence of slack in the end portion of the winding at the winding piece 12*a*.

As explained, in accordance with the ignition coil of the present invention, the wind-ending portion of the secondary winding wound around the secondary bobbin can be positively fixed by the binding portion. As a result, the winding is prevented from slacking at the binding portion. The present invention can eliminate the occurrence of the short circuit which is sometimes caused in the conventional ignition coils.

Obviously, numerous modifications and variations of the present invention are possible in light of the above teachings. It is therefore to be understood that within the scope of the appended claims, the invention may be practiced otherwise than as specifically described herein.

What is claimed is:

1. An ignition coil having a secondary winding wound on and around a secondary bobbin, having one end of the secondary winding connected to a high voltage terminal, and having a portion of the secondary winding close to the connected end engaged with a binding portion formed on a circumferential edge of one end of the secondary bobbin, wherein the binding portion comprises a winding piece which projects outwardly in the radial direction of the secondary bobbin and around which an end portion of the secondary winding is wound in several turns, and an engaging piece which is formed to extend from the leading edge of the winding piece along the central axis the secondary bobbin and which has a side surface formed with a groove for inserting the secondary winding for clipping.

* * * * *